United States Patent [19]

Frishman et al.

[11] 4,119,373

[45] Oct. 10, 1978

[54] ELECTROGRAPHIC APPARATUS AND METHOD FOR USING ARSENIC SELENIDE AS THE PHOTOCONDUCTOR

[75] Inventors: Leslie O. Frishman, St. Paul; Kerry S. Nelson, Shoreview, both of Minn.

[73] Assignee: Minnesota Mining and Manufacturing Company, St. Paul, Minn.

[21] Appl. No.: 664,950

[22] Filed: Mar. 8, 1976

[51] Int. Cl.[2] ..... G03G 15/02

[52] U.S. Cl. ..... 355/3 R; 96/1 R; 355/3 CH

[58] Field of Search ..... 355/3 R, 3 CH; 96/1 R, 96/1.3, 1.4

[56] References Cited

U.S. PATENT DOCUMENTS

| | | | |
|---|---|---|---|
| 3,041,167 | 6/1962 | Blakney et al. | 96/1.3 X |
| 3,533,783 | 10/1970 | Robinson | 96/1 R |
| 3,615,395 | 10/1971 | Yamaji et al. | 96/1.4 |
| 3,834,809 | 9/1974 | Yoshizawa et al. | 355/3 R |
| 4,035,750 | 7/1977 | Staudenmayer et al. | 355/3 R |

FOREIGN PATENT DOCUMENTS

| | | | |
|---|---|---|---|
| 1,324,851 | 7/1973 | United Kingdom | 355/3 R |

*Primary Examiner*—A. D. Pellinen

*Attorney, Agent, or Firm*—Cruzan Alexander; Donald M. Sell; Robert L. Marben

[57] ABSTRACT

An improvement to the method and apparatus of producing multiple copies of a document using a copy machine having an arsenic selenide photoconductive layer and wherein a development technique is used that is capable of providing uniformly-filled solid areas. The improvement includes the step of exposing the photoconductive layer to light energy prior to uniformly charging the photoconductor for each copy to be produced with such light energy and the light energy used for exposing the charged photoconductor to the light image of the document selected in terms of light energy and spectral distribution to establish a stablized fatigue level for the photoconductive layer thereby eliminating objectionable image density variations between successive copies made of the original.

8 Claims, 2 Drawing Figures

ELECTROGRAPHIC APPARATUS AND METHOD FOR USING ARSENIC SELENIDE AS THE PHOTOCONDUCTOR

BACKGROUND OF THE INVENTION

This invention relates to the use of arsenic selenium photoconductive layers in electrophotography, and, in particular, to an apparatus and method of making multiple copies of an original document when using arsenic selenide as the photoconductor without observing objectionable image density variations between the various copies produced.

Electrophtographic copy machines are known which are based on the development of an electrostatic image presented by a photoconductive element and perform the process steps which include placing a uniform electrostatic charge on the photoconductor, exposing the charged photoconductor to a light image obtained from the document to be copied thereby creating on the surface of the photoconductor a differential potential pattern in accordance with the light image, developing the differential potential pattern by the presentation of toner particles to the photoconductor using a development technique capable of providing uniformly-filled solid areas, transferring the toner developed image directly or indirectly to a receptor, such as paper, fixing the toner to the paper and a cleaning step for removing residual toner on the photoconductor following exposure of the photoconductor to a pre-clean light source.

When photoconductive elements using a layer formed of glasses of the arsenic selenium system as disclosed in U.S. Pat. Nos. 2,803,542 to Ullrich and 2,822,300 to Mayer are used as the photoconductor in a copy machine employing the copy process described above and a number of copies of an original document are made in rapid succession, a noticeable and objectionable decrease in image density will occur between the first and second copy with additional image density degradations or variations occurring to some degree with each successive copy made.

These observable copy density variations are the result of the well-known light fatigue effect exhibited by many materials containing selenium and particularly by arsenic selenide wherein an increase in the rate of dark decay of the surface potential has been observed with repeated cycles of charging and exposure. The amount of fatigue or the fatigue level will eventually reach a maximum after a period of continuous cycling.

Generally, light fatigue can be measured by monitoring the surface potential response of a photoconductor in the development region as the photoconductor completes repeated cycles while functioning to reproduce a particular document containing both solid black and gray areas. A cyclic decrease in the measurable surface potential is caused by light fatigue and will result in a degradation in image density with successive copies when a development technique is used that is sensitive to absolute potential levels on the photoconductor. Such development techniques are generally capable of providing uniformly-filled solid image areas.

One solution to the fatigue problem and, therefore, the variable copy density problem presented by a photoconductor of the arsenic selenium system is disclosed in U.S. Pat. No. 3,511,649 to E. J. Felty et al which recognizes that the fatigue of photoconductors of the arsenic selenium system is wavelength dependent. The patent to Felty et al provides for reduction of the fatigue to an acceptable level by using interference filters to cut out all wavelengths from the imaging light source that exceed about 5400 angstroms or 540 nanometers.

SUMMARY OF THE INVENTION

The present invention provides an apparatus and method for rapidly making successive copies which do not exhibit objectionable copy density variations when using an arsenic selenide photoconductor without using the teachings of the Felty et al patent, which requires completely excluding all visible light exceeding 540 nanometers during the copy process. The present invention provides for immediate stabilization and control of the fatigue of an arsenic selenide photoconductor at any desired level when used in a copy machine for rapidly making a number of copies of an original document in succession. For purposes of defining the scope of the present invention, the fatigue of an arsenic selenide photoconductor layer is considered to be stabilized or controlled at a level when the surface potential of the arsenic selenide does not vary a sufficient amount to contribute to any objectionable image density variations between successive copies of an original made using a development technique in the copy process of the type capable of providing for uniformly-filled solid image areas. A development technique of such type includes, for example, known magnetic brush development systems and the development system described in U.S. Pat. No. 3,909,258 to A. R. Kotz. The present invention requires a pre-charging exposure step for subjecting the portion of the arsenic selenide photoconductor layer that is to be imaged to light energy. The pre-charging exposure step is used each time the step of placing a uniform electrical charge on the photoconductor is used in the copy process and is carried out prior to such charging step. As used herein, the term, light energy, refers to the use of light of a definite intensity for a specific period of time. All light energy to which the arsenic selenide is subjected during the copy process including that containing the imagewise pattern contributes to the stabilization or control of the fatigue level requiring careful selection and control of the spectral distribution and light energy of all light striking the surface of the arsenic selenide.

In addition, it has been discovered that the use of light energy during the pre-charging exposure step containing predominantly short wavelength visible light provides a method of stabilizing or controlling the fatigue of the arsenic selenide photoconductor layer at a level wherein a substantially higher uniform surface potential is provided than is the case when relatively long wavelength visible light is used during the pre-charging step. A high surface potential is desirable for some development processes that are usable in copy machines.

In one copy machine employing the method of this invention, the pre-charging exposure of the arsenic selenide photoconductor for the first copy produced is provided by a first light source which is used only for the first copy with a second light source providing the necessary light energy for maintaining the arsenic selenide in the fatigue level established by the first light source when more than one copy is produced. The second light source is positioned to also function as a pre-clean lamp.

BRIEF DESCRIPTION OF THE DRAWINGS

For a more complete understanding of the invention, reference should be made to the accompanying drawings wherein.

DESCRIPTION

Figure 1:
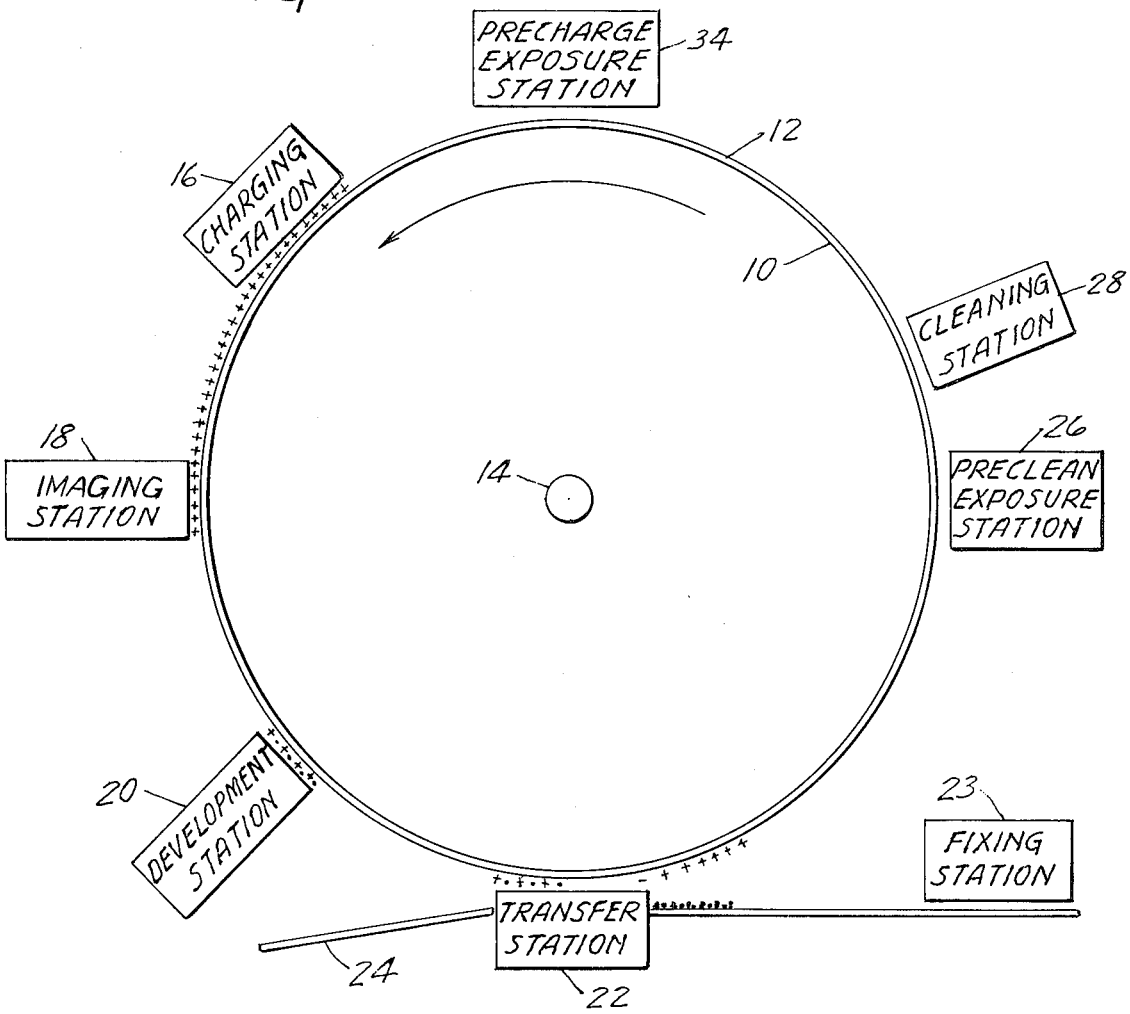
FIG. 1 is a schematic showing of an imaging system employing the method of this invention.

An imaging system usable in an automatic copy machine for making multiple copies of a document is shown schematically in FIG. 1. It is operated in accordance with the method of this invention, which is an improvement to basic copying processes using arsenic selenide as the photoconductor. The imaging system includes a photoconductive plate provided by an electrically conductive drum 10 having an outer photoconductive layer 12 of arsenic selenide. The drum is mounted on a shaft 14 journaled in a frame (not shown) for rotation in the direction indicated by the arrow to present the photoconductive layer sequentially to a plurality of processing stations at a uniform speed. The various processing stations which are used in the basic copy process that is improved by this invention are all well known in the art and all can take on various forms so they need only be described functionally.

The various processing stations of the basic prior art copy process considered in the order in which they are presented in the path of movement of the photoconductive layer may be described functionally as follows:

At approximately eleven o'clock in FIG. 1, a charging station 16, which may be a positive charge corona, is operated to deposit a uniform electrostatic charge on a portion of the arsenic selenide photoconductive layer 12. The charged portion of layer 12 is then presented to an imaging station 18, at which a light pattern or image of a document to be reproduced is projected onto the charged layer 12 to dissipate the drum charge in the light exposed areas to form a latent potential pattern of the document to be reproduced. The latent potential pattern is then presented to a developing station 20 which is of the type employing a development technique capable of providing uniformly-filled solid areas at which time toner particles are deposited on the potential pattern bearing surface to form a toned image in the configuration of the document being produced. A transfer station 22 is provided for transferring the developed image from the surface of the photographic layer directly or indirectly onto the surface of a receptor to which the image is then fixed by a fixing station 23. For example, plain paper 24 can be presented to the image layer in timed relationship to the movement of drum 10 to receive the developed image directly from the photoconductive layer using electrostatic means to effect the transfer. In such case, an electrostatic charge of the same polarity as the charge placed on the drum at the charging station is applied to the side of the paper away from the drum to electrostatically transfer the developed image to the paper. The drum 10 moves to present the photoconductive layer to a pre-clean or discharge station 26 which provides a source of light energy that is directed to the photoconductive layer to effect substantially complete discharge of any electrostatic charge remaining on the photoconductive layer. A cleaning station 28 provides the next and final step in the copy process and serves to remove any residual toner particles that may remain on the photoconductive layer so the photoconductive layer may be used to make the next copy.

This apparatus and the method as described presents no problem if only one copy of the document is produced. However, non-uniform copies will be observed when a number of copies of the original document in rapid succession are produced. The non-uniformity is most easily detected by a decrease in image density of the low density solid image areas.

Figure 2:
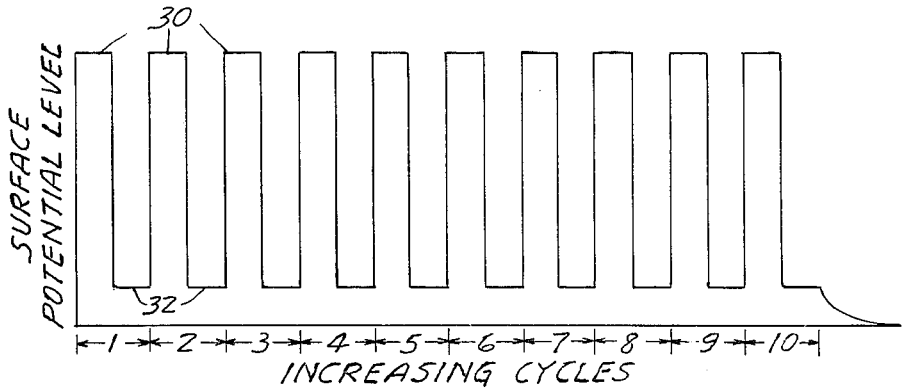
FIG. 2 is a graph of the ideal surface potential pattern presented by a photoconductor prior to development when making successive copies of a document.

FIG. 2 is a graph of the ideal surface potential characteristics for a photoconductor used in a process for making multiple copies in rapid sucession. For each recurring cycle of the copy process the plot in FIG. 2 shows the surface potential level 30 corresponding to the areas of the photoconductor which are subjected to relatively little or no light from the imaging station 18 and the surface potential level 32 corresponding to the areas of the photoconductor which are subjected to a relatively large amount of light from the imaging station 18. While more variation can be tolerated with respect to the surface potential 30 corresponding to the dense areas of an image, change in the surface potential 32 for the less dense areas from the first to say the tenth copy is more important, since any copy non-uniformity is more readily detected by a person viewing the less dense areas in the first and a later copy of a series of multiple copies that have been produced.

In the case of arsenic selenide, increasing fatigue of the arsenic selenide causes a substantial reduction in the surface potential levels 30 and 32 which occurs between the first and later copy cycles to cause objectionable density variations between copies when the development station used is of the type designed for providing uniformly-filled solid images. It has been discovered that during such a copy process the arsenic selenide can be exposed to light energy and spectral distribution sufficient to stabilize or control the fatigue level of the arsenic selenide such that the absolute surface potential pattern on the photoconductor is substantitially the same for each copy cycle when a number of copies are produced in rapid succession and thus avoid objectionable non-uniformity between copies. This is accomplished in part by the introduction of an additional step into the copy process that has been described which provides for exposing the photoconductor to light energy prior to the arsenic selenide being uniformly charged for each copy cycle with such light energy being sufficient to controllably fatigue the arsenic selenide. It is convenient to supply the light energy for such step for the first copy to be made by the use of a pre-charge exposure station 34 positioned between the cleaning station 28 and the charging station 16. The stabilization or control of the fatigue at a desired level is completed by the selection and control of the light provided at the imaging station 18 in terms of its light energy and spectral distribution. For example, it has been found that the use of a fluorescent lamp at the pre-charge station 34 with a tungsten lamp at the imaging station 18 requires removal of some of the red portion of the energy provided by the tungsten lamp to provide a stabilized or controlled fatigue level and, thus, repetitively obtain substantially the same absolute surface potentials for each copy cycle. In another example, which will be set forth in more detail, the use of a green lamp at the pre-charge station 34 with a tungsten lamp at the imaging station 18 required the removal of a substantially higher percentage of the red portion of the energy provided by the tungsten lamp to provide a stabilized or controlled fatigue level.

It has been discovered that light energy containing predominantly short wavelengths, provided, for example, by green electroluminescent strips, can be used during the pre-charge exposure step to fatigue the arsenic selenide. This approach provides a stabilized fatigue level which causes the surface potential at the arsenic selenide to be greater than that provided when the light energy used to fatigue the arsenic selenide contains relatively uniform spectral distribution of long and short wavelengths as is the case when light from a fluorescent lamp is used for the pre-charge exposure step.

It is convenient to use a pre-charge exposure station 34 positioned between the cleaning station 28 and charging station 16 to provide the light for the pre-charge exposure step only for the first copy to be produced. The necessary light for the pre-charge exposure step for the second and any subsequent copy cycles in a multi-copy situation is provided by the light source at the pre-clean station 26. Since the pre-clean station 26 and the pre-charge station 34 are used with the same light energy provided at the imaging station 18, the same type of light source is used for the pre-clean station 26 and the pre-charge station 34. If, for example, a fluorescent light source is used at the pre-clean station 26, a fluorescent light source is used for the pre-charge station 34. However, due to the difference in the physical spacings of the pre-charge station 34 and the pre-clean station 26 with respect to the charging station, the amount of light energy supplied to the arsenic selenide by pre-charge station 34 may differ from that provided by the pre-clean station 26 in order that the fatigue level provided by the operation of the pre-charge station 34 and the imaging station 18 during the first copy cycle and the fatigue level provided by the operation of the pre-clean station 26 and the imaging station 18 will be substantially the same.

It can be appreciated that the pre-charge exposure station 34 can be eliminated and only the light at the pre-clean station 26 used for the pre-charge exposure step to provide the light energy to fatigue the arsenic selenide. Such structure requires the drum 10 to be initially moved past the pre-clean station without supplying any paper to the transfer station to fatigue the arsenic selenide. Use of the pre-charge exposure station 34 is preferred, since the time for producing the first copy is much less than is the case if only the lamp at the pre-clean station is used.

A copier using the imaging system as described in connection with FIG. 1 has been operated to produce identical multiple copies using pre-charge and pre-clean light sources which provide either predominantly short wavelength light or which provide both short and long wavelength light. Identical multiple copies were obtained in both situations. However, the use of predominantly short wavelength light sources resulted in operation of the arsenic selenide photoconductor at a controlled fatigue level wherein it is fatigued to a considerably lesser extent than the other case.

A drum 10 about 15.2 centimeters in diameter having a photoconductive layer 12 of arsenic selenide about 50 to 70 micrometers thick was used. The drum was operated at a constant linear surface speed of 15.2 centimeters/sec. and charged using a positive corona generating device. In one case, two 1-$\frac{7}{8}$ inch-wide green electroluminescent lamps positioned approximately 1.0 centimeter from the arsenic selenide surface were used in the pre-charge and pre-clean stations to provide predominantly short wavelength light. Elecroluminescent lamps manufactured by Ovonics, Inc., and designated as type No. 243, were used. They were both operated at 220 volts, 60 cycles to provide an irradiance of about 11 microwatts/cm$^2$. At these operating conditions, the electroluminescent lamps have a bell-shaped spectral intensity distribution curve with greater than 20 percent emission occurring from about 450 nanometers to about 580 nanometers with the peak intensity being at about 520 nanometers. A 400 watt tungsten halogen lamp operating at a color temperature of about 2700° K. was used in the exposure station to illuminate the original to be copied. To establish a constant and controlled fatigue level, the imagewise pattern created by the tungsten halogen lamp illuminating the original was carefully and selectively filtered by placing a cold mirror in the optical path to substantially reduce the amount of light of wavelengths greater than about 605 nanometers from reaching the arsenic selenide surface. The specific cold mirror used had a relatively sharp cutoff with less than 10 percent transmission at wavelengths less than about 565 nanometers and greater than 90 percent transmission at wavelengths greater than about 605 nanometers. Using these conditions, the maximum energy incident on the arsenic selenide surface through a 1.1 centimeter-wide exposure slot was about 40 $\mu\Omega$/cm.$^2$. providing a peak exposure of about 2.8 $\mu\Omega$-sec./cm$^2$.

In a second example, General Electric "cool white" fluorescent lamps (designated GE type F7T5) were used at the pre-charge and pre-clean stations. These lamps have a relatively uniform spectral distribution from about 400 nanometers to about 700 nanometers. Each fluorescent lamp was mounted in an enclosure such that it could effectively illuminate a 0.7 centimeter wide portion of the arsenic selenide surface. The pre-charge lamp was adjusted to provide an energy incident on the arsenic selenide surface of about 100 microwatts/cm$^2$. The pre-clean lamp was adjusted to provide an energy incident on the arsenic selenide surface of about 140 microwatts/cm$^2$. The same 400 watt tungsten halogen lamp operating at a color temperature somewhat less than 2700° K. was used in the exposure station to illuminate the original to be copied. However, to establish a constant and controlled fatigue level in this case, the imagewise pattern created by the tungsten halogen lamp illuminating the original was selectively filtered by placing a cold mirror in the optical path to substantially reduce the amount of light of wavelengths greater than about 720 nanometers from reaching the arsenic selenide surface. The specific cold mirror used had a relatively sharp cutoff with less than 10 percent transmission at wavelengths less than about 690 nanometers and greater than 90 percent transmission at wavelengths greater than about 720 nanometers. As in the first example, multiple copies were made using these conditions which exhibited no objectionable image density variation between copies.

In the light of the above teachings, alternative arrangements and techniques embodying the invention will be suggested to those skilled in the art. The scope of protection afforded the invention is not intended to be limited to the specific embodiments disclosed, but is to be determined only in accordance with the appended claims.

1. An improvement to the method of producing multiple copies of a document using a copy machine having an arsenic selenide photoconductive layer which includes the steps of placing a uniform electrostatic charge on the photoconductor, exposing the charged photoconductor to a light image obtained from the document thereby creating on the surface of the photoconductive layer a differential potential pattern corresponding to the light image, developing the differential potential pattern by the application of toner particles to the photoconductor wherein a development technique is used that is capable of providing uniformly-filled solid areas, transferring the toner developed image to a receptor, fixing the toner to the receptor and removing any residual toner on the photoconductor following exposure of the photoconductor to a pre-clean light source, the improvement including the step of exposing the photoconductor to light energy prior to charging the photoconductor for each copy to be produced, said light energy and the light energy used during the step for exposing the charged photoconductor to a light image being selected and maintained in terms of light energy and spectral distribution to establish the arsenic selenide photoconductor at a stabilized fatigue level for the first and each subsequent copy.

2. The method of claim 1 wherein said light energy applied prior to charging the photoconductor is predominantly short wavelength visible light.

3. The method of claim 1 wherein said copy machine includes a plurality of fixed positions at which the various steps are carried out and means for moving said photoconductor progressively to said positions, said positions including one position having a pre-charge light source and another position at which said preclean light source is located, said step of exposing said photoconductor to light energy prior to charging the photoconductor being carried out at said one position by energization of said pre-charge light source for only the first copy of said multiple copies and being carried out by energization of said pre-clean light source for each of the remaining copies of said multiple copies.

4. The method of claim 3 wherein the light energy provided by said pre-charge light source and by said preclean light source is predominatly short wavelength visible light.

5. An improvement to an apparatus for producing multiple copies of a document, said apparatus having an arsenic selenide photoconductive layer, means for placing a uniform electrostatic charge on said photoconductive layer, means for exposing said charged photoconductive layer to a light image obtained from the document thereby creating on the surface of the photoconductive layer a differential potential pattern corresponding to the light image, means for developing the differential potential pattern by the applicatin of toner particles to said photoconductor wherein a development technique is used that is capable of providing uniformly-filled solid areas, means for transferring the toner developed image to a receptor, means for fixing the toner to the receptor, a pre-clean light source for exposing said photoconductor to light energy after the toner developed image has been transferred, and means for removing any residual toner on the photoconductive layer following presentment of the photoconductor to said pre-clean light source, the improvement including means for exposing the photoconductor layer to light energy prior to charging the photoconductive layer for each copy to be produced, said last-mentioned means and the means for exposing said charged photoconductor to a light image adapted for providing light energy that is selected and maintained with respect to light energy and spectral distribution to establish a stabilized fatigue level for the photoconductor for the first and each succeeding copy made with the apparatus.

6. The apparatus of claim 5 wherein said means for exposing the photoconductive layer to light energy prior to charging the photoconductive layer includes a pre-charge light source adapted for such use prior to production of only the first copy and said pre-clean light source of providing the light energy prior to charging said photoconductor for each of the remaining copies of the multiple copies produced.

7. The apparatus of claim 5 wherein said means for exposing the photoconductive layer to light energy prior to charging the photoconductive layer provides predominantly short wavelength visible light.

8. The apparatus of claim 6 wherein said pre-charge light source and by said pre-clean light source provides light energy that is predominantly short wavelength visible light.

* * * * *

UNITED STATES PATENT AND TRADEMARK OFFICE

CERTIFICATE OF CORRECTION

PATENT NO. : 4,119,373

DATED : October 10, 1978

INVENTOR(S) : Leslie O. Frishman and Kerry S. Nelson

It is certified that error appears in the above-identified patent and that said Letters Patent are hereby corrected as shown below:

Col. 5, line 31, change "spacings" to -- spacing --.

Col. 6, line 29, change "$\mu\Omega/cm.^2$." to -- $\mu\omega/cm.^2$ --.

Col. 6, line 30, change "$\mu\Omega$-sec/$cm.^2$" to -- $\mu\omega$-sec./$cm.^2$ --.

Col. 8, line 10, change "applicatin" to -- application --.

Col. 8, line 35, delete "of" and insert -- for -- .

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*